United States Patent [19]

Akagawa et al.

[11] Patent Number: 4,556,139

[45] Date of Patent: Dec. 3, 1985

[54] BILL ACCEPTING DEVICE

[75] Inventors: Masaki Akagawa, Sakado; Hideaki Onda, Ageo; Osamu Kobayashi, Sakado; Kenji Nishiumi, Hannoh, all of Japan

[73] Assignee: Kabushiki Kaisha Nippon Coinco, Tokyo, Japan

[21] Appl. No.: 498,841

[22] Filed: May 27, 1983

[30] Foreign Application Priority Data

May 28, 1982 [JP] Japan ..... 57-89701

[51] Int. Cl.[4] ..... G07F 7/04

[52] U.S. Cl. ..... 194/4 C; 209/534

[58] Field of Search ..... 194/4 R, 4 C, 4 E, DIG. 9, 194/DIG. 26; 209/534; 235/379

[56] References Cited

U.S. PATENT DOCUMENTS

| | | | |
|---|---|---|---|
| 3,447,655 | 6/1969 | Tanaka et al. | 194/4 R |
| 3,976,198 | 8/1976 | Carnes, Jr. et al. | 209/534 |
| 4,011,931 | 3/1977 | Wyckoff | 194/4 C |
| 4,398,088 | 8/1983 | Hirose et al. | 235/379 |

OTHER PUBLICATIONS

Japanese Patent Preliminary Publication No. 182295/1982.

*Primary Examiner*—Stanley H. Tollberg

*Attorney, Agent, or Firm*—Spensley, Horn, Jubas & Lubitz

[57] ABSTRACT

This bill accepting device comprises a bill discrimination section for discriminating whether an inserted bill is true or not, an escrow section capable of retaining a bill accepted by the bill discrimination section as a true bill and returning the retained bill, a stocker section for storing the bill accepted by the bill discrimination section as a true bill, and passage switching means for causing a bill passage in the bill discrimination section to communicate selectively either with the escrow section or with the stocker section. The passage switching section normally communicates the bill discrimination section with the escrow section to enable an inserted bill to be retained in the escrow section in a state in which the bill can be readily returned. When the escrow section has become full, the passage is switched so that the inserted bill is guided from the bill discrimination section to the stocker section.

13 Claims, 11 Drawing Figures

M1
M3
M4
M5
P1
P2
P3
P4
P5
SOL
ESW
FSW
CSW
LSW
II
A

BILL ACCEPTING DEVICE

BACKGROUND OF THE INVENTION

This invention relates to a bill accepting device used in a vending machine, exchanger or the like device.

A bill accepting device comprises at least a bill discrimination unit performing a function of discriminating whether a deposited bill is a true bill or a counterfeit one and accepting the true bill and returning the counterfeit one and a receiving unit for receiving the accepted bill. For enabling a once accepted bill to be returned if required, the receiving unit must be constituted of an escrow unit which temporarily retains the bill and, in this case, a stocker unit which stores bills overflowing the escrow unit must be additionally provided. A prior art bill accepting device of this type is disclosed in the specification of Japanese Patent Preliminary Publication No. 182295/1982. This prior art device is so constructed that one bill which has just been accepted is temporarily retained in an escrow unit and this bill retained in the escrow unit is stored in a stocker when vending has been made. In this prior art device, each bill insertion and vending operation must be accompanied by two steps of operations, i.e., operation for pulling the bill into the escrow unit and the operation for transferring the bill from the escrow unit to the stocker with a result that a long operation time is required.

It is an object of the present invention to provide a novel bill accepting device which has eliminated the above described disadvantage of the prior art device.

In the bill accepting device of the type as was disclosed in the above mentioned Japanese Patent Preliminary Publication No. 182295/1982, a bill is normally not retained in the escrow device so that collection of bills can be effected by collecting only bills accumulated in the stocker. Accordingly, an inventory operation has not been considered in the prior art bill accepting device. In the bill accepting device to be proposed in the present invention, however, there is provided a bill passage switching section which causes a bill passage of the bill discrimination section to communicate selectively either with the escrow section or with the stocker section so that the number of bills which can be retained in the escrow section can be increased to some extent. Then a question arises as to how to collect bills retained in the escrow section when bills are collected from a vending machine or exchanger.

It is, therefore, another object of the invention to provide, in the novel bill accepting device proposed by the present invention, an inventory device capable of effectively collecting bills which have already been retained in the escrow device.

In the bill stocker device, it is very important for management of vending machines to know a state of accumulation of bills. For knowing such state of accumulation, conceivable methods include detection of reaching of an amount of accumulation to a predetermined upper limit or performing counting upon accumulation of each bill. It is still another object of the invention to provide a signal generation device usable for both of the detection of the upper limit of accumulation and detection of the number of the accumulated bill one by one.

It is another object of the invention to provide a bill accumulation device capable of effectively storing a large number of bills.

SUMMARY OF THE INVENTION

The above described primary object of the invention can be achieved by a bill accepting device which comprises a bill discrimination section for discriminating whether an inserted bill is true or not, an escrow section capable of retaining a bill accepted by the bill discrimination section as a true bill and returning the retained bill, a stocker section for storing the bill accepted by the bill discrimination section as a true bill and passage switch means for causing a bill passage in the bill discrimination section to communicate selectively either with the escrow section or with the stocker section. By switching the passage by means of the passage switching means, a bill accepted by the bill discrimination section can be directly guided to either the escrow section or the stocker section whereby the operation time required for storing the bill can be shortened. Switching control is performed by the passage switching means such that when, for example, the number of bills retained in the escrow section has not reached a predetermined number, the accepted bill is guided to the escrow section and when the number has reached the predetermined one, the accepted bill is guided to the stocker section.

According to the invention, both temporary retention and storing of a bill become possible by providing the escrow section and the stocker section separately so that a once accepted bill can be returned as a return money or change money and also a large number of bills can be accumulated. By branching of the bill passage to the escrow section and the stocker section, a fairly large number of bills can be retained in the escrow section so that the number of returnable bills can be increased. Consequently, a large number of bills can be used at once in a vending machine and exchanger.

The bill discrimination section, escrow section and stocker section generally include a driving mechanism for conveying a bill. By providing a passage switching means in the device according to this invention, the movement of a bill may be hampered at the bifurcation. For preventing clogging of a bill at the bifurcation, a suitable drive means should preferably be provided for assisting carrying of a bill in the passage switching section.

An effective inventory processing in the bill accepting device according to the invention is achieved by an inventory device which automatically transfers bills retained in the escrow section to the stocker section. As a result of this automatic transfer, all of the stored bills are carried to the stocker section and the supervisor has only to collect bills accumulated in the stocker section.

According to a preferred embodiment of the invention, there is provided a novel bill stocker device comprising a pair of flat portions fixedly provided with a predetermined interval therebetween, said interval being narrower than the width of a bill, vertical movement means having a horizontal plate movable between the flat portions and being capable of lifting the horizontal plate from a first position lower than the level of the flat portions to a second position higher than the level of the flat portions and thereafter lowering the horizontal plate to the first position, and a cover placed vertically movably above the flat portions, a bill being accumulated between the cover and the flat portions by vertically moving the plate once in a reciprocating motion when the bill is transferred onto the plate located in the first position. A signal generation device proposed in the present invention comprises, in the above described stocker device, a switch and operation means being adjustable in a set position thereof in a vertical direction at one or more positions or continuously for operating the switch, one of the switch and the operation means being fixed at a predetermined height and the other being disposed on a side wall of the cover whereby a signal corresponding to a raised position of the cover is provided by the switch. The switch or the operation means disposed on the cover is lifted as the cover is lifted and the switch is actuated to produce a signal by the operation means in response to its height. The height at which the switch is actuated can be selected as desired in response to the set position of the operation means. The switch may be of any type including mechanical, magnetic and photoelectric conversion types. The operation means may be of any suitable type corresponding to the type of the switch such, for example, as a projection, a magnet and a light emitting element.

DESCRIPTION OF A PREFERRED EMBODIMENT

Figures 1, 2:
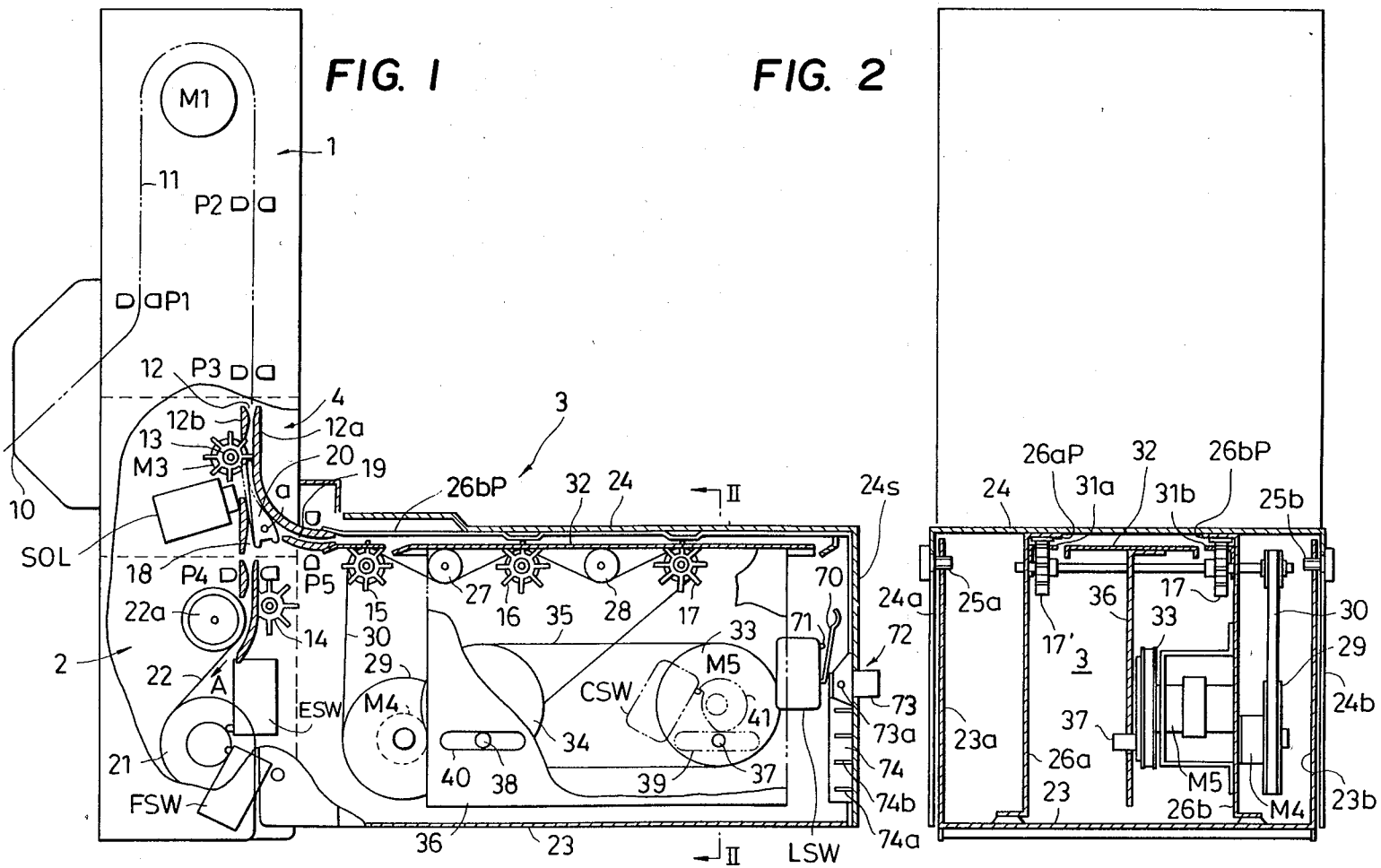
FIG. 1 is a sectional side elevation showing an embodiment of the bill accepting device according to the invention.
FIG. 2 is a sectional view along line II—II in FIG. 1.
Figure 3A:
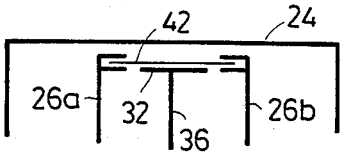
FIG. 3 (*a*)–3(*e*) are schematic views of a stocker section for explaining the bill receiving and stocking operation of the stocker section.
Figure 3B:
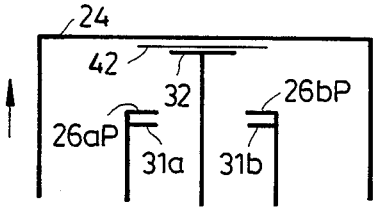
Figure 3C:
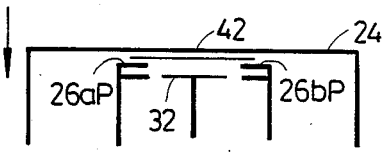
Figure 3E:
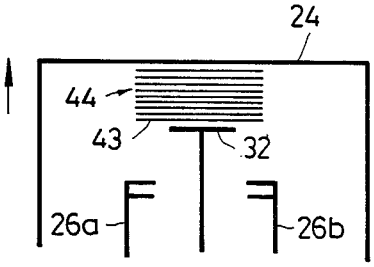
Figure 3D:
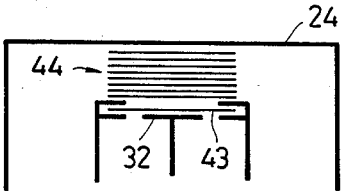

Referring first to FIG. 1, the bill accepting device comprises a bill discrimination section 1 for discriminating a true bill from a counterfeit one among deposited bills, an escrow section 2 for temporarily retaining a bill which has been judged to be a true bill and received by the bill discrimination section 1 (retaining the bill in a state in which the bill can be automatically returned), a stocker section 3 for accumulating a received bill in a state in which the bill cannot be automatically returned and a passage switching section 4 for switching a passage of bills. The bill discrimination section 1 is incorporated in a main body of the bill accepting device whereas the escrow section 2 and the stocker section 3 are detachably mounted on the main body. The passage switching section 4 may either be incorporated in the main body or formed integrally with the escrow section 2. In FIG. 1, the sectional side elevations of the escrow section 2, the stocker section 3 and the passage switching section 4 are shown in a state in which their housing is partially removed. A sectional view along line II—II in FIG. 1 is shown in FIG. 2.

In FIG. 1, a side plane of a bill passage in the bill discrimination section 1 is shown by a two-dot chain line 11. Sensors P1, P2 and P3 are provided in suitable places in the bill passage 11 for detecting positions of a bill passing through the passage 11. There are also provided other sensors in the bill discrimination section 1 for detecting whether a deposited bill is true or false. As these latter sensors are not the subject matter of the present invention, description thereof in detail will be omitted. The sensors P1, P2 and P3 are composed, for example, of photocouplers each consisting of a pair of light emitting and receiving elements provided across the passage 11. Sensors P4 and P5 to be described later are of the same construction. The sensor P1 is provided in the vicinity of an entrance of the passage 11 to detect insertion of a bill into the insertion slit 10. The sensor P3 is provided in the vicinity of an exit of the passage 11 in the discrimination section 1. The sensor P2 is provided in a predetermined place between the sensors P1 and P3.

A motor M1 in the discrimination section 1 serves to control feeding of a bill in the discrimination section 1, carrying the bill in a direction in which the bill is received, (i,e. toward the escrow section 2) during a forward rotation and in a direction in which the bill is returned (i, e., toward the insertion slit 10) during a reverse rotation. If the inserted bill has been found a true one, the bill is received whereas if it has been found a counterfeit one, it is returned.

The exit of the bill passage 11 (i, e., the exit on the side of the sensor P3) communicates with a bill passage 12 of the passage switching section 4. The passage 12 is illustrated as an opening defined by two walls 12*a*, 12*b*. In the vicinity of the passage 12, there is provided a bill feeding roller 13. In FIG. 1, only one each of rollers 13, 14, 15, 16 and 17 is illustrated but these rollers respectively consist of a pair of rollers which are disposed with an interval which is slightly narrower than the width of the bill. The pair of the rollers 17, 17′ is shown in FIG. 2. The bill feeding roller 13 is made, for example, of rubber formed with projections along the periphery thereof and disposed such that the bill is held and carried between the projections and the wall 12*a* of the passage 12. The other rollers 14–17 are of a similar construction. A motor M3 is provided in association with the roller 13 for assisting feeding of the bill, the roller 13 being rotated forwardly or reversely in accordance with a forward or reverse rotation of the motor M3.

Immediately below the roller 13, the bill passage 12 is branched into passages 18 and 19. At this bifurcation, there is provided a flapper 20 for switching the feeding direction of the bill. The passage 18 leads to a bill retention device in the escrow section 2 whereas the passage 19 leads to the stocker section 3. The flapper 20 is controlled in two positions by a solenoid SOL. The solenoid SOL is normally off and the flapper 20 is attracted to the wall 12*a* as shown by a solid line in FIG. 1 by a suitable means such as a spring (not shown) thereby blocking the passage 19 and enabling the passage 12 to communicate with the passage 18. Upon turning on of the solenoid SOL, the flapper 20 is rotated counterclockwise about its axis to a position shown by a chain line thereby blocking the passage 18 and enabling the passage 12 to communicate with the passage 19.

In the vicinity of the entrance of the escrow section 2 communicating with the passage 18, there is provided the sensor P4 for detecting the bill which is fed to or out of the escrow section 2. In the escrow section 2, a coil spring 22 is fixed at one end thereof to a predetermined place of a drum 21 which is driven by a motor M2 and the bill is inserted between the coil spring 22 and a winding member using this drum 21 as a core and wound tightly on the winding member. More specifically, the bill which has entered the escrow section 2 through the passage 18 proceeds into a space between the winding member using the drum 21 as the core and the spring 22 along an arrow A. By rotating the drum 21 forwardly by the motor M2 at a suitable timing (counterclockwise rotation as viewed in the figure), the spring 22 is wound on the drum 21 and the bill proceeding in the direction of the arrow A with the spring is tightly wound on the drum 21. For paying out the bill wound on the drum 21 toward the passage 18, the motor M2 is rotated reversely. The spring 22 is wound on a core 22*a* by a self restoring force by the length corresponding to the reverse rotation of the motor M2 and, as a result, the bill is paid out in a direction opposite to the arrow A.

No driving force is imparted to the roller 14 provided near the sensor P4 but the roller 14 is rotated in response to the movement of the bill. An emptiness detector ESW and fullness detector FSW are provided in association with the motor M2. When the motor M2 is in an initial position, i, e., no bill is wound on the drum 21 at all, the emptiness detector ESW is actuated to detect the emptiness of the drum 21. When the motor M2 is rotated forwardly from the initial position by a predetermined amount, the fullness detector FSW provided through a reduction gear device (not shown) is actuated to detect the fullness of the drum 21. In the illustrated embodiment, the fullness detector FSW is actuated when seven bills have been wound on the drum 21 but any desired number of bills may be wound to actuate the fullness detector FSW.

The solenoid SOL is off until the number of bills wound on the drum 21 has reached a predetermined number of fullness and the flapper 20 thereby enables the passage 12 to communicate with the passage 18 causing the bill sent from the bill discrimination section 1 to be guided to the escrow section 2. When the number of bills wound on the drum 21 has reached the predetermined number of fullness, the fullness detector FSW is turned on and the solenoid SOL thereby is turned on to switch the flapper 20 to the position shown by the chain line. The bill sent from the bill discrimination section 1 thereby is guided from the passage 12 to the passage 19. The sensor P5 is provided in the passage 19 to detect the bill to be sent to the stocker section 3.

The stocker section 3 comprises a base 23 and a cover 24. Studs 25*a*, 25*b* are fixed to side walls 23*a*, 23*b* rising from the base 23. A space which is slightly wider than thickness of the cover 24 is defined between the head portion of each of the studs 25*a*, 25*b* and corresponding one of the side walls 23*a*, 23*b*. The side walls of the cover 24 are of about the same height as the side walls 23*a*, 23*b* of the base 23 and vertical slots 24*a*, 24*b* opening at one end thereof are formed in the side walls 23*a*, 23*b* in locations corresponding to the studs 25*a*, 25*b*. The engagement of the slots 24*a*, 24*b* and the studs 25*a*, 25*b* permits a free vertical movement of the cover 24 unaccompanied by any horizontal movement.

Plate-like support frames 26*a*, 26*b* for supporting a bill conveying device and a cover vertical movement device are fixed to the base 23. Rotation shafts of the bill conveying rollers 15, 16, 17 (17') and pulleys 27 and 28 are pivotally supported by the support frames 26*a*, 26*b* at upper portions thereof. A bill conveying motor M4 is mounted on the frame 26*b* and rotation of the motor M4 is transmitted to the rollers 15, 16, 17 and 17' through a transmission mechanism consisting of pulleys 29, 27 and 28 and a belt 30. As the motor M4 is rotated forwardly, the rollers 15, 16 and 17 are rotated in the direction in which the bill is fed into the stocker section 3. Upper edge portions of the frames 26*a*, 26*b* are bent perpendicularly to form flat portions 26*a*P, 26*b*P respectively. Elongated plates 31*a*, 31*b* for receiving bills are mounted inside of the frames 26*a*, 26*b* such that these plates are located somewhat below the flat portions 26*a*P, 26*b*P. The bill is received at upper and lower edge portions thereof in space defined between the flat portions 26*a*P, 26*b*P and the bill receiving plates 31*a*, 31*b*.

As will be seen in the side view of FIG. 1, parts of the flat portions 26*a*P, 26*b*P corresponding to the rollers 16 and 17 are slightly projecting toward the rollers 16 and 17 so that the bill is held between these projecting parts and the rubber projections of the rollers 16 and 17 and an accurate feeding of the bill thereby is ensured.

The flat portions 26*a*P, 26*b*P and the plated 31*a*, 31*b* are respectively spaced apart from each other to permit the vertical movement of a horizontal plate 32 of a vertical movement device. The vertical movement device comprises a motor 5, a pulley 33 driven by this motor M5, a pulley 34 of the same diameter as the pulley 33 to which the rotation of the pulley 33 is transmitted through a belt 35, a vertical plate 36 and the horizontal plate 32. The pulleys 33 and 34 are secured to the frame 26*b*. The pulleys 33 and 34 have projections 37 and 38 which are engaged in horizontal slots 39 and 40 formed in the vertical plate 36. As the pulleys 33, 34 are rotated with the rotation of the motor M5, the projections 37, 38 perform a circular movement which causes the vertical plate 36 to move vertically due to the engagement of the projections 37, 38 with the slots 39, 40. One rotation of the pulleys 33, 34 results in one reciprocal vertical movement of the plate 36. The horizontal plate 32 is secured to the vertical plate 36 at the upper end portion thereof. In a normal state, the projections 37, 38 of the pulleys 33, 34 are at their lowermost position as shown in FIG. 1 and the vertical plate 36 also is at its lowermost position. In this state, the horizontal plate 32 is substantially on the same level as the elongated plates 31*a*, 31*b* which receive the upper and lower edges of the bill. A cam 41 is provided on the rotation shaft of the motor M5 and a carrier switch CSW is provided in association with this cam 41. One rotation of the motor M5 is ensured by this carrier switch CSW.

Upon detection of a bill by the sensor P5, the motor M4 is driven and the bill is pulled into the stocker section 3 through the passage 19. The length of the horizontal plate 32 is nearly equal to the vertical length of the bill. When the bill being fed with its upper and lower edges being inserted between the flat portions 26*a*P, 26*b*P is placed substantially in its entire horizontal length on the plate 32, the rotation of the motor M4 is stopped. This state is shown in FIG. 3(*a*). FIGS. 3(*a*-)-3(*e*) are schematic views corresponding to FIG. 2. FIG. 3(*a*) shows a state in which a bill 42 is pulled for the first time onto the horizontal plate 32 while no bill has yet been accumulated in the stocker section 3. Then one rotation of the motor M5 is effected. When the motor M5 is rotated from 0 degree to 180 degrees, the plates 36 and 32 are moved upwardly to push up the bill 42 on the horizontal plate 32. The pushed up bill 42 is initially bent such that the upper and lower edges thereof are let out of the space between the flat portions 26*a*P, 26*b*P and the elongated plates 31*a*, 31*b* whereby the upward movement of the bill 42 with the plate 32 is made possible. As the horizontal plate 32 moves upwardly, the bill 42 is held between the plate 32 and the cover 24 and the bill 42 and the cover 24 are moved upwardly, pushed by the plate 32 as shown in FIG. 3(*b*). When the motor M5 is rotated from 180 degree to 360 degree, the plates 36 and 32 are moved downwardly whereby the cover 24 and the bill 42 are lowered. When the lower surface of the bill 42 has come into abutting engagement with the flat portions 26*a*P, 26*b*P of the frames 26*a*, 26*b*, the downward movement of the bill 42 and the cover 24 is stopped whereas the plates 32 and 36 continue the downward movement to the lowermost position. The above is one cycle of the bill receiving operation in the stocker section. The bill 42 is finally received between the flat portions 26*a*P, 26*b*P and the cover 24.

By repetition of the above described one cycle of the bill receiving operation, a bill 43 to be newly received (FIG. 3(*d*)) is added to the bottom of a stack of bills 44 (FIG. 3(*d*)) which have already been accumulated between the cover 24 and the flat portions 26*a*P and 26*b*P. As shown in FIG. 3(*e*), the plate 32 causes the new bill 43 to be added to the bottom of the bills 44 by the upward movement thereof and these bills 43 and 44 and the cover 24 to be pushed up together. As the plate 32 lowers subsequently, the new bill 43 is held between the old bills 44 and the flat portions 26*a*P, 26*b*P. In this manner, bills are accumulated in a stack between the cover 24 and the flat portions 26*a*P, 26*b*P. The cover 24 moves upwardly and downwardly by a predetermined stroke during one cycle of the vertical movement of the plate 32 and its position at a standstill gradually rises.

Figure 4:
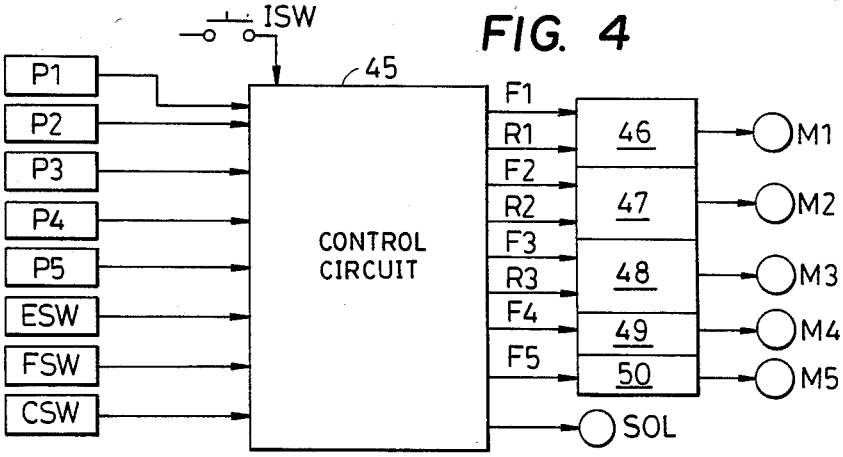
FIG. 4 is an electrical block diagram showing a control system of the embodiment shown in FIG. 1.

Referring to FIG. 4 which is the block diagram showing the control system of the bill accepting device of FIG. 1, outputs of the sensors P1–P5, the detectors ESW, FSW and CSW and the inventory switch ISW are applied to a control circuit 45. Driving of the motors M1–M5 and the solenoid SOL is controlled by the output of the control circuit 45. Reference characters 46–50 designate driver circuits of the respective motors M1–M5. The motors M1, M2 and M3 can be rotated either forwardly or reversely in response to forward rotation orders F1–F3 or reverse rotation orders R1–R3 whereas the motors M4 and M5 are rotated only forwardly in response to forward rotation orders F4 and F5. Illustration of inputs and outputs relating to discrimination as to whether a deposited bill is a true bill or not is omitted.

Figure 5:
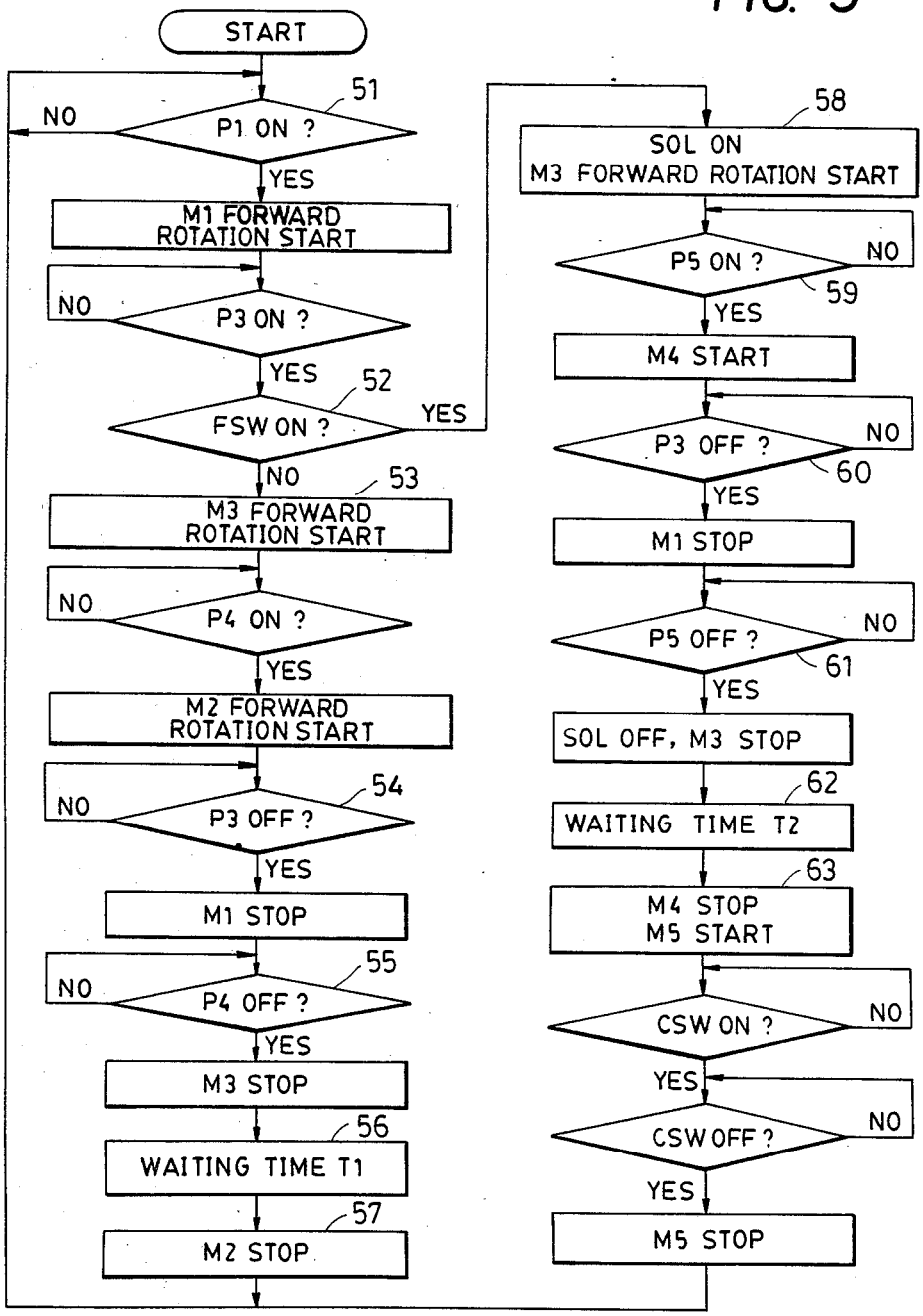
FIG. 5 is a flow chart showing an example of a deposited bill receiving and stocking control implemented by the control circuit shown in FIG. 4.

FIG. 5 is a flow chart showing only portions relating to the present invention of the control operation by the control circuit. In FIG. 5, the processing relating to the discrimination as to whether the deposited bill is true or not is omitted. Accordingly, the following description is made on the assumption that the deposited bill is a true bill.

In block 51, whether the sensor P1 is on or not is examined. It is assumed that the "on" state of the sensors P1–P5 represents a state in which a bill has been detected. Upon insertion of the bill in the bill insertion slit 10, the sensor P1 is turned on. A forward rotation of the motor M1 thereby is started and the inserted bill is carried into the passage 11. Upon reaching of the tip of the inserted bill at the sensor P3, the sensor P3 is turned on and judgement of block 52 is made. In the block 52, whether the fullness detector FSW in the escrow section 2 is on or not is judged.

If the number of bills retained in the escrow section 2 has not reached a predetermined number representing fullness, block 52 is NO in which case a processing to hold a bill in the escrow section 2 is performed. First, a forward rotation of the motor M3 is started in block 53. The bill which has entered the switching section 4 passing by the sensor P3 thereby is further carried on by the roller 13 driven by the motor M3. As was previously described, the solenoid SOL is off in a normal state and the flapper 20 is in such a position that the passage 12 communicates with the passage 18. The bill is thereby fed to the escrow section 2. Upon turning on of the sensor P4 provided at the entrance of the escrow section 2, the forward rotation of the motor M2 is started and the bill is gradually wound between the drum 21 and the spring 22. When the rear end of the bill has passed by the sensor P3, "P3 off!" in block 54 becomes YES and the motor M1 is thereby stopped. When the rear end of the bill has subsequently passed by the sensor P4, "P4 off!" in block 55 becomes YES and the motor M3 is thereby stopped. Thereafter, a timer is started in block 56 whereby the operation is suspended until a predetermined operation time T1 has elapsed. Upon lapse of the timer time T1, the processing shifts to block 57 in which the motor M2 is stopped. The time T1 is a brief period of time required for displacement of the rear end of the bill from the sensor P4 to a point at which winding of the bill on the drum is started.

In the above described manner, the deposited bill is led to the escrow section 2 until the escrow section 2 becomes full. When the escrow section 2 has become full, the fullness detector FSW is turned on and the judgement of block 52 becomes YES. The processing for receiving the deposited bill into the stocker section 3 thereby is performed. In block 53, the solenoid SOL is turned on and the forward rotation of the motor M3 is started. When, accordingly, the forward end of the deposited bill has reached the sensor P3, the solenoid SOL is turned on and the flapper 20 is switched to the position shown by the chain line thereby causing the passage 12 to communicate with the passage 19. Simultaneously, the roller 13 is driven by driving of the motor M3 causing the bill which has passed by the sensor P3 and entered the switching section 4 to be carried toward the stocker section 3. When the forward end of the bill has reached the sensor P5, the sensor P5 is turned on and the motor M4 is started in response to "YES" of block 59. The rollers 15, 16 and 17 thereby are rotated carrying the bill to the horizontal plate 32 in the stocker section 3. As turning off of the sensor P3 is confirmed in block 60, the motor M1 is stopped. Further, as turning off of the sensor P5 is confirmed in block 61, the motor M3 is stopped and the solenoid SOL is turned off. When the rear end of the bill has passed by the sensor P5, the sensor P5 is turned off. In block 62, the timer is started and the operation is suspended until a predetermined operation time T2 has elapsed. Upon lapse of the timer operation time T2, the processing shifts to block 63 in which the motor M4 is stopped and the motor M5 is started. The timer time T2 is a brief period of time required for displacement of the rear end of the bill from the sensor P5 to the vicinity of the end portion of the horizontal plate 32. When, accordingly, the bill has been placed in its entire length on the horizontal plate 32, the feeding of the bill by the motor M4 is completely stopped and the motor M5 is started. The carrier switch CSW is turned on by the rotation of the motor M5 and the rotation of the motor M5 is continued. When the motor M5 has completed one rotation, the carrier switch CSW is turned off and the motor M5 thereby is stopped. During one rotation of the motor M5, the vertical plate 36 and the horizontal plate 32 perform one stroke of the vertical movement as was described with reference to FIG. 3, accumulating the deposited bills in the space between the flat portions 26*a*P, 26*b*P of the frame and the cover 24.

In a case where a once received bill is to be returned toward the insertion slit 10, the motors M2, M3 and M1 are reversely rotated, the solenoid SOL is retained in an off state and the bills retained in the escrow section 2 are fed toward the passage 11 of the discrimination section 1. Description of the processing therefor in the control circuit 45 is omitted.

In taking out bills accumulated in the bill accepting device, the bills accumulated in the stocker section 3 can be readily taken out by opening the cover 24 but the bills in the escrow section 2 must be automatically paid out by some means. For this purpose, an inventory processing is performed in the control circuit 45 by manipulating the inventory switch (take-out order switch) ISW to control the motors M1–M5 and the solenoid SOL so that the bills in the escrow section 2 are transferred to the stocker section 3. Thus, the bills retained in the escrow section 2 are all transferred automatically to the stocker section 3 and thereafter all bills in the stocker section 3 are taken out by opening the cover 24.

Figure 6:
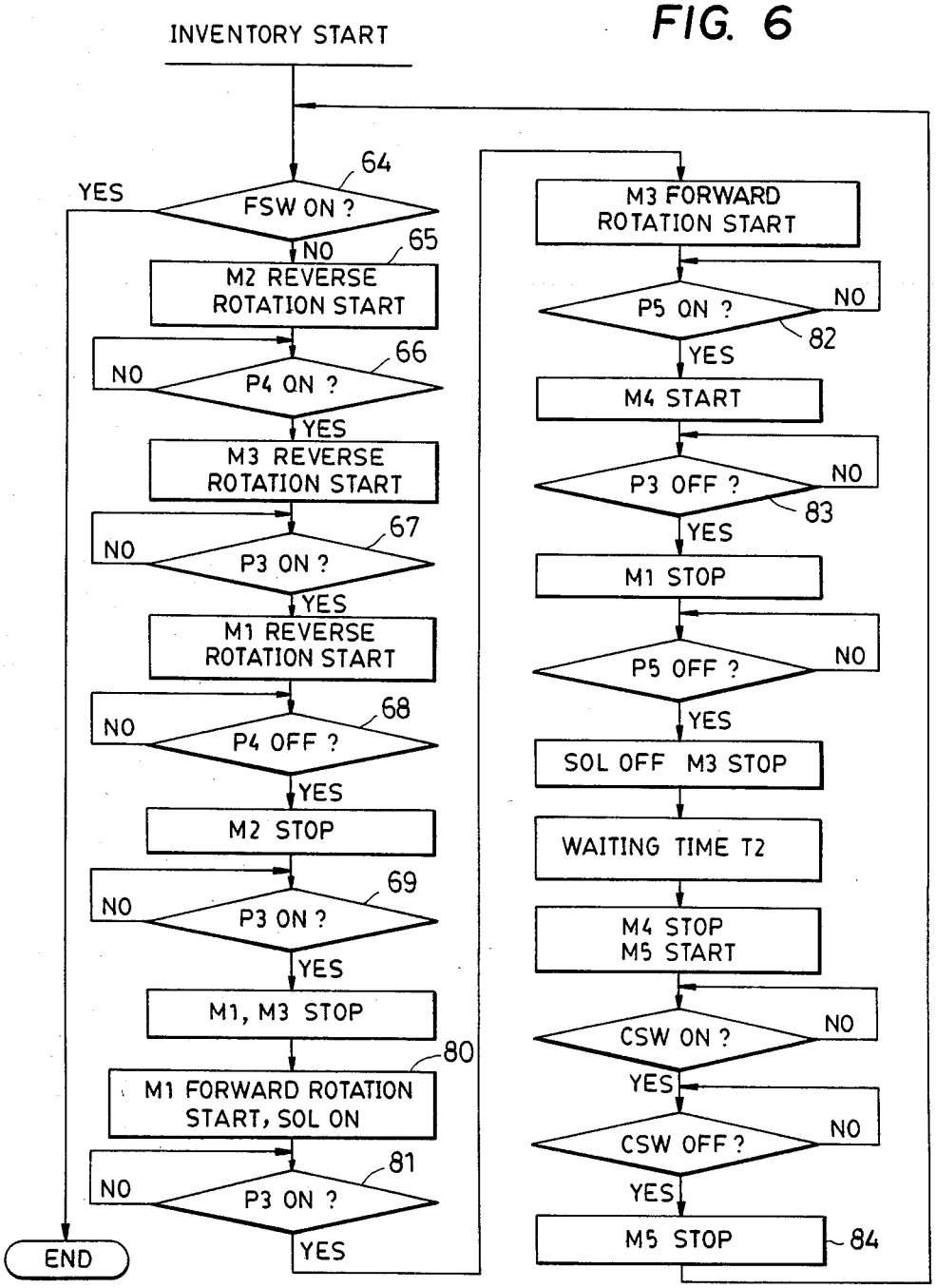
FIG. 6 is a flow chart of an inventory control program implemented by the control circuit shown in FIG. 4.

Although not shown in FIG. 1, the manually operated inventory switch ISW is provided in a suitable place and the control circuit 45 in FIG. 4 performs the inventory processing routine as shown in FIG. 6.

In block 64, whether the emptiness detector ESW is on or not is judged. If even a single bill is retained in the escrow section 2, the emptiness detector ESW is off so that block 64 becomes NO. In block 65, the reverse rotation of the motor M2 is started. By the reverse rotation of the motor M2, the bills which have been wound on the drum 21 are paid out one by one in a direction opposite to the arrow A in FIG. 1. Upon detection of the forward end of the paid out bill by the sensor P4, block 66 becomes YES and the reverse rotation of the motor M3 thereby is started. The solenoid SOL remains off at this time so that the flapper 20 is in the position in which the passage 12 communicates with the passage 18. Accordingly, the bill paid out by the escrow section 2 proceeds from the passage 18 to the passage 12, the reverse carrying of the bill being assisted by the roller 13. Thus, the bill enters the discrimination section 1. Upon detection of the forward end of the reversely fed bill by the sensor P3, block 67 becomes YES and the reverse rotation of the motor M1 is started. The bill thereby is further fed reversely in the passage 11 in the discrimination section 1. When the rear end of the bill has passed by the sensor P4, the motor M2 is stopped and delivery of the bill from the escrow section 2 is temporarily stopped. During this time, the bill which has already been paid out is further fed reversely by the reverse rotation of the motors M3 and M1. When this bill has entered the discrimination section 1 completely and the rear end of this bill has passed by the sensor P3, block 69 becomes YES. The motors M1 and M3 are thereby stopped and the bill is stopped in the passage 11 when it has passed by the sensor P3. Then the forward rotation of the motor M1 is started and the solenoid SOL is turned on by processing in block 80. The flapper 20 is switched to cause the passage 12 to communicate with the passage 19. The bill which has once been stopped in the passage 11 is again carried toward the switching section 4. Upon detection of the forward end of the bill by the sensor P3, block 81 becomes YES and the forward rotation of the motor M3 is started. In this manner, the bill which has entered the switching section 4 is fed toward the stocker section 3 through the passage 19 by driving of the motors M1 and M3.

Upon detection of the forward end of the bill by the sensor P5, block 82 becomes YES and the motor M4 is started. In the subsequent flow of blocks 83–84, the same processing as in the flow of blocks 60–63 in FIG. 5 is performed and bills are accumulated in the space between the flat portions 26*a*P, 26*b*P in the stocker section 3 and the cover 24.

In the above described manner, a bill is delivered out of the escrow section 2 and, after once being fed to the bill discrimination section 1, it is transferred to the stocker section 3 by switching the feeding direction of the bill. A processing for stopping the motor M5 is finally effected in block 84 and the transferring processing for one bill is completed. The routine returns to block 64 in which the state of the emptiness detector ESW is examined. If the escrow section 2 is not empty, the routine of FIG. 6 is repeated to transfer another bill from the escrow section 2 to the stocker section 3. Bills retained in the escrow section 2 are transferred to the stocker section one by one in the foregoing manner. When the escrow section 2 has become empty, block 64 becomes YES and the inventory operation is completed.

Although not shown in the flow chart of FIG. 6, an arrangement is made such that if a bill is detected by the sensor P1 when another bill is detected by the sensor P2 during the inventory operation (i.e., during the forward rotation of the motor M1), the motor M1 is stopped so as not to pull in the bill inserted in the insertion slit 10. In this case, if the bill inserted in the insertion slit 10 is pulled out, the sensor P1 is turned off and the forward rotation of the motor M1 is resumed.

Reverting to FIG. 1, an accumulated amount detection switch LSW is provided at a predetermined height in the stocker section 3. The switch LSW may, for example, consist of a mechanical type limit switch including an actuator 70 in the form of a leaf spring and a projection 71 pushed by the actuator 70. On the wall 24S of the cover 24, an operation means 72 for the switch LSW is mounted at a location opposite to the switch LSW. The operation means 72 includes a knob 73 having a projection 73*a* and a knob mounting base 74 on which the knob 73 can be mounted such that its mounting position can be adjusted in several different heights (e.g. 5 positions). The knob mounting base 74 has recesses 74*a*, 74*b* . . . at these different mounting positions and an inside projection (not shown) of the knob 73 is detachably engaged in one of these recesses 74*a*, 74*b* etc. Each of the mounting position of the knob 73 corresponds to one of various bill accumulation amounts in the stocker section 3. The accumulation amount increases as the mounting position is lowered.

Since the operation means 72 moves vertically with the cover 24 whereas the switch LSW is fixed, the projection 73*a* of the knob 73 actuates the actuator 70 of the switch LSW in accordance with the height of the cover 24 thereby turning on the switch LSW.

As a single bill fed into the stocker section 3 through the passage 19 is vertically moved by the vertical movement device including the horizontal plate 32 and is received in the space between the flat portions 26*a*P, 26*b*P and the cover 24, the operation means 72 also performs one vertical reciprocating movement. If the distance between the set position of the knob 73 and a switch actuating point of the actuator 70 (a point at which the switch LSW is turned on when it is pushed) is within the stroke of the vertical movement, the switch LSW is temporarily actuated when the cover 24 moves vertically thereby producing an ON output signal of a short pulse. By applying this short pulse ON output signal to a counter for counting, the number of bills accumulated in the stocker section 3 can be counted one by one. In the embodiment shown in FIG. 1, one pulse corresponding to one stroke of the vertical movement can be produced by the switch LSW when the knob 73 is set in the highest position (corresponding to the least amount of accumulation).

As the amount of accumulated bills increases, the position of the cover 24 rises by a height corresponding to the amount of accumulated bills. Correspondingly, the height of the knob 73 rises relative to the switch LSW and, when the amount of the accumulated bills has reached an amount corresponding to the set position of the knob 73, the switch actuating point of the actuator 70 coincides continuously with the projection 73*a* thereby to push the actuator 70 continuously and operate the switch LSW continuously. Thus, the switch LSW produces the ON output signal continuously. This continuous ON output signal of the switch LSW is utilized as an accumulated amount upper limit detection signal. In response to this accumulated amount upper limit detection signal, a control can be effected for prohibiting feeding of a bill to the stocker section 3, i.e., prohibiting insertion of a bill by preventing the forward rotation of the motor M1 when the bill has been inserted in the insertion slit 10. In a case where the state of a vending machine is remotely watched by a central computer, a bill take-out demand should preferably be displayed in a central watch room so that the operation of taking bills out of the stocker section 3 may be promptly conducted.

Figure 7:
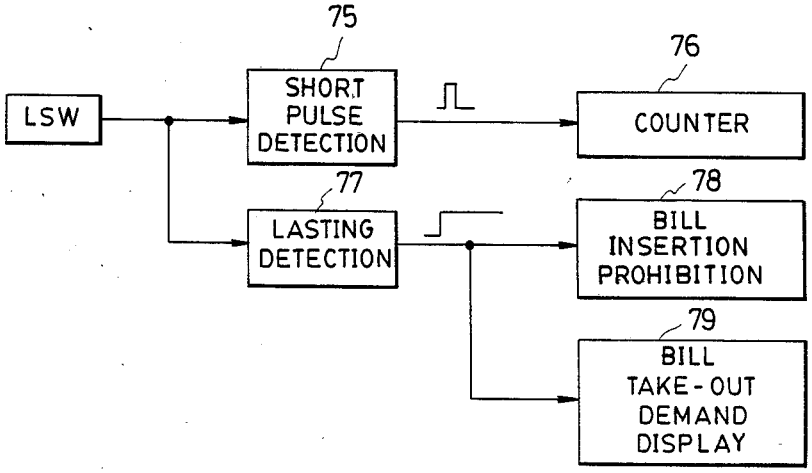
FIG. 7 is an electrical block diagram showing an example of utilization of the output signal of an accumulation amount detection switch provided in the embodiment of FIG. 1.

An example of utilization of the output signal of the switch LSW is shown in FIG. 7. A short pulse detection circuit 75 detects that a switch-on output is a short pulse and thereby causes a counter 76 to count up. A lasting detection circuit 77 detects that the switch-on output is a lasting signal and thereby operates a bill insertion prohibition control device 78 and a bill take-out demand display device 19.

The set positions of the knob 73 of the operation means are not limited to 5 positions. Further, the set position may be one which can be adjusted continuously. Furthermore, the set position may be only one. It should be noted, however, that there are various types of vending machines and exchangers utilizing the bill accepting device and various devices corresponding to a selected type are mounted in the space above the stocker section 3 shown in FIG. 1. Accordingly, the upper limit position of the cover 24 cannot be uniformly determined but it can be varied. If, accordingly, there are several set positions for the operation means 72 to provide several upper limit positions, the bill accepting device can be advantageously applied to these various types of vending machines and exchangers. Further, it is not impossible to provide the switch LSW on the cover and fix the operation means 72.

In the stocker section 3 in the above described embodiment, the cover 24 functions as a bias plate which is always biased due to gravity in the direction of the flat portions 26*a*P, 26*b*P. This bias plate may be constructed such that it is biased by a spring or the like pressing force imparting means with a force which is weaker than the driving force of the reciprocating plate (horizontal plate 32). In this case, the stocker section 3 may not necessarily be horizontally disposed as shown in FIG. 1 but may be disposed vertically or obliquely.

What is claimed is:

1. A bill accepting device comprising:

a bill discrimination section containing means for discriminating whether or not an inserted bill is true and for returning rejected bills, and having a bill passage through which bills can exit said discrimination section;

an escrow section into which bills can be received from said discrimination section for storage therein and for subsequent reissuance via said discrimination section;

a stocker section into which bills can be received from said discrimination section; and passage switching means for causing said bill passage in said bill discrimination section to communicate selectively either directly with said escrow section or alternatively, directly with said stocker section.

2. A bill accepting device as defined in claim 1, wherein said passage switching means comprises:

a first passage communicating with the bill passage in said bill discrimination section;

a second passage communicating with said escrow section;

a third passage communicating with said stocker section;

a passage switching member disposed at a bifurcation of said first, second and third passages and being capable of positioning selectively either in a first position communicating said first passage with said second passage and blocking said third passage or in a second position communicating said first passage with said third passage and blocking said second passage; and control means for controlling said passage switching member either to said first position or to said second position in response to an electrical signal.

3. A bill accepting device as defined in claim 1 wherein said passage switching means performs a passage switching control such that the bill accepted by said bill discrimination section is fed to said escrow section while the number of bills retained in said escrow section has not reached a predetermined number whereas the bill accepted by said bill discrimination section is fed to said stocker section after the number of bills retained in said escrow section has reached the predetermined number.

4. A bill accepting device as defined in claim 2 wherein said control means normally controls said passage switching member to said first position and controls to said second position when the bill in said bill passage in said bill discrimination section is to be fed to said stocker section.

5. A bill accepting device as defined in claim 1 wherein said bill discrimination section, said escrow section and said stocker section respectively comprise drive means for carrying bills and drive means is also provided in association with said passage switching means for assisting carrying of bills.

6. A bill accepting device as defined in claim 1 which further comprises:

an inventory switch which is to be operated when collection of bills is ordered; and a control device controlling, responsive to the operation of said inventory switch, feeding of bills in said bill discrimination section, said escrow section and said stocker section and controlling passage switching in said passage switching means such that bills retained in said escrow section are once transferred to said bill discrimination section and thereafter are transferred from said bill discrimination section to said stocker section.

7. A bill accepting device as defined in claim 6 wherein said control device comprises:

a first sensor for detecting a bill passing through said bill discrimination section and said passage switching means;

a second sensor for detecting a bill passing through said escrow section and said passage switching means;

an emptiness detector for detecting absence of a bill retained in said escrow section; and a control circuit which, in response to outputs of said inventory switch, and said first and second sensors, controls the bill feeding operations in said respective sections and also controls the switching operation in said passage switching means thereby to transfer bills retained in said escrow section one by one to said stocker section and complete transferring of bills upon detection of absence of a bill retained in said escrow section by said emptiness detector.

8. A bill accepting device comprising:

a bill discrimination section for discriminating whether an inserted bill is true or not;

an escrow section capable of retaining a bill accepted by said bill discrimination section as a true bill and returning the retained bill;

a stocker section for storing the bill accepted by said bill discrimination section as a true bill;

passage switching means for causing a bill passage in said bill discrimination section to communicate selectively either with said escrow section or with said stocker section; and wherein said stocker section comprises:

a pair of flat portions fixedly provided with a predetermined interval therebetween, said interval being narrower than the width of a bill;

vertical movement means having a horizontal plate movable through said flat portions and being capable of lifting said horizontal plate from a first position lower than the level of said flat portions to a second position higher than the level of said flat portions and thereafter lowering said horizontal plate to said first position; and a cover placed vertically movably above said flat portions, a bill being accumulated between said cover and said flat portions by vertically moving said plate once in a reciprocating motion when the bill is transferred onto said plate located in said first position.

9. A bill accepting device as defined in claim 8 which further comprises a signal generation device in association with said stocker section, said signal generation device includes a switch and opertion means being adjustable in a set position thereof in a vertical direction at one or more positions or continuously for operating the switch, one of said switch and said operation means being fixed at a predetermined height and the other being disposed on a side wall of said cover whereby a signal corresponding to a raised position of said cover is provided by said switch.

10. A bill accepting device as defined in claim 9 wherein said switch is temporarily actuated by said operation means in response to the vertical movement of said cover caused by the vertical movement of said horizontal plate and an output signal of said switch corresponding to this temporary actuation is utilized as an accumulated bill counting signal.

11. A bill accepting device as defined in claim 9 wherein said switch is continuously actuated by said operation means when said cover has risen to a predetermined height in accordance with the amount of accumulation of bills in a space between said flat portions and said cover and an output of said switch corresponding to this continuous actuation is utilized as an accumulation amount upper limit detection signal.

12. A bill accumulating device comprising:

a pair of opposed channels disposed in a generally horizontal plane and spaced apart by a distance slightly greater than the width of a bill, a bill entering said acceptor being supported by having its edges within said respective opposed channels;

a plate situated between said opposed channels and vertically movable between a first position below the plane of a bill entering said acceptor and a vertically higher position; and, a downwardly biased, movable cover situated about said opposed channels, upward movement of said plate catching a bill supported between said opposed channels and carrying it upward into contact with said cover or a bill previously accepted below said cover, the downward movement of said cover catching said accepted bills between said cover and the top of said opposed channels when said plate is thereafter moved downwardly to a plane below said opposed channels.

13. A bill accepting device as defined in claim 1 wherein said escrow section reissues bills on a last in, first out basis.

* * * * *